United States Patent [19]

Adams

[11] Patent Number: 4,813,811

[45] Date of Patent: Mar. 21, 1989

[54] PREFABRICATED PAVEMENT DEVICES

[75] Inventor: Wilbur R. Adams, Terre Haute, Ind.

[73] Assignee: Simulators Limited, Inc., Terre Haute, Ind.

[21] Appl. No.: 65,937

[22] Filed: Jun. 23, 1987

[51] Int. Cl.[4] ..... E01F 9/00

[52] U.S. Cl. ..... 404/15; 404/7; 404/9; 404/13; 404/28; 404/31; 404/38; 428/489; 428/40

[58] Field of Search ..... 404/6, 7, 9, 13, 15, 404/16, 28, 29, 31, 34, 35, 37, 38, 41, 45, 70; 428/40, 489; 52/388, 390, 612

[56] References Cited

U.S. PATENT DOCUMENTS

| | | | |
|---|---|---|---|
| 3,568,579 | 3/1971 | Hoad, Jr. | 404/35 X |
| 3,853,682 | 12/1974 | Hurst | 428/40 |
| 4,012,156 | 3/1977 | Turner | 404/15 |
| 4,074,948 | 2/1978 | Heater, Jr. | 404/35 X |
| 4,151,025 | 4/1979 | Jacobs | 404/31 X |
| 4,203,685 | 5/1980 | Sanchez | 404/6 |
| 4,342,525 | 8/1982 | Mastronuzzi, Jr. | 404/6 |
| 4,362,424 | 12/1982 | Barber | 404/6 |
| 4,478,912 | 10/1984 | Uffner et al. | 28/40 X |
| 4,684,288 | 8/1987 | Chapa | 404/35 |
| 4,687,370 | 8/1987 | Knowles | 404/15 |
| 4,697,294 | 10/1987 | Schafer | 404/16 X |

FOREIGN PATENT DOCUMENTS

| | | | |
|---|---|---|---|
| 757778 | 4/1971 | Belgium | 428/489 |
| 2225358 | 12/1972 | Fed. Rep. of Germany | 428/489 |
| 2030197 | 4/1980 | United Kingdom | 404/15 |
| 2175335 | 11/1986 | United Kingdom . | |

*Primary Examiner*—Stephen J. Novosad
*Assistant Examiner*—John F. Letchford
*Attorney, Agent, or Firm*—Howrey & Simon

[57] ABSTRACT

The invention is directed to a prefabricated composite pavement device comprising a shaped pavement mixture portion bonded to a support portion and a method and apparatus for making the same.

9 Claims, 3 Drawing Sheets

PREFABRICATED PAVEMENT DEVICES

BACKGROUND OF THE INVENTION

Speed bumps and similar devices have long been used by highway and road designers and engineers to control the speed of vehicles along the road. These devices have also found use in driveways and parking lots and in other places where vehicle speed must be controlled.

Frequently speed bumps are formed on location from paving material such as blacktop or bituminous. This method, however, requires lengthy disruptions of the normal traffic flow. Moreover, on-site formation of speed bumps is imprecise; the height and width of the devices—which are directly related to the maximum speed with which vehicles can pass over the devices—cannot easily be controlled.

Rumble strips, multiple narrow raised pavement sections arranged perpendicular to the flow of traffic, have been used by highway designers and engineers as a means of warning vehicle operators of upcoming hazards or obstacles such as sharp curves and toll booths. As with speed bumps, warning strips are typically formed in place from pavement material. Prior art warning strips therefore have the same deficiencies as the prior art speed bumps: lengthy disruptions of normal traffic flow and imprecision in size and shape.

It is therefore one object of this invention to provide a prefabricated pavement device which can be applied to highways or parking lots quickly and easily with minimal disruption of traffic.

It is another object of this invention to provide speed bumps, warning strips and pavement devices in relatively precise predetermined shapes and sizes for accuracy in traffic control.

It is a further object of this invention to provide a method for making prefabricated pavement devices in relatively precise predetermined shapes and sizes.

It is yet another object of this invention to provide an apparatus for making prefabricated pavement devices in relatively precise predetermined shapes and sizes.

SUMMARY OF THE INVENTION

These and other objects of the invention are provided in a prefabricated composite pavement device comprising a pavement mixture layer shaped to a predetermined width, thickness and cross-section and a support layer attached to one side of the pavement mixture layer, the composite being cut into predetermined lengths having ends adapted to be matingly engaged with each other.

DESCRIPTION OF THE PREFERRED EMBODIMENTS

Figure 1:
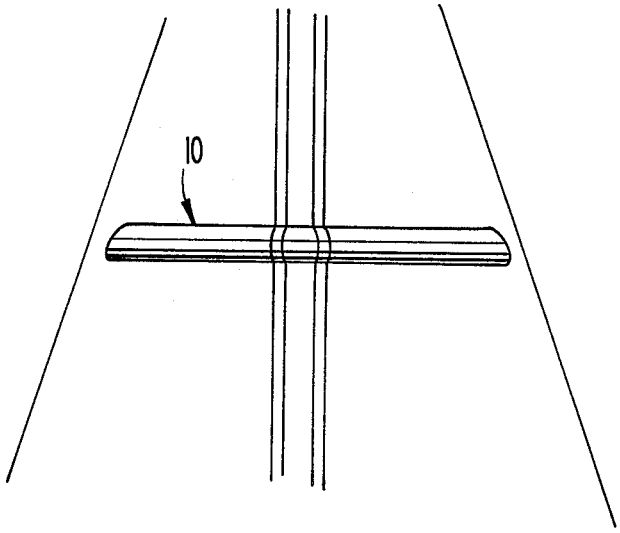
FIG. 1 is a view of an application of a composite pavement device according to this invention.
Figure 2:
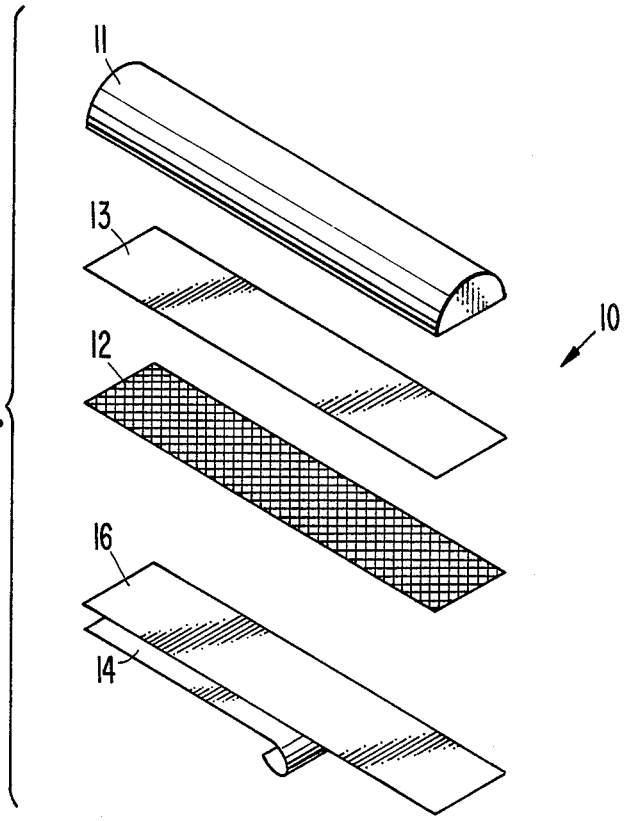
FIG. 2 is an exploded view of a composite pavement device.

Referring to FIGS. 1 and 2, the composite pavement device 10 is comprised essentially of an upper pavement mixture portion 11 and a lower support portion 12. Pavement mixture portion 11 may be formed from bituminous emulsions or aggregate and bituminous emulsions or any other suitable material. In the preferred embodiment, support portion 12 is formed from rolls of stock wire, plastic mesh or any suitable support material cut to predetermined widths. Below the pavement mixture portion 11 and above the support portion 12 is an adhesive layer 13 which binds the pavement mixture to the support. In the preferred embodiments, adhesive layer 13 may be a standard epoxy or any other suitable adhesive.

Figure 3:
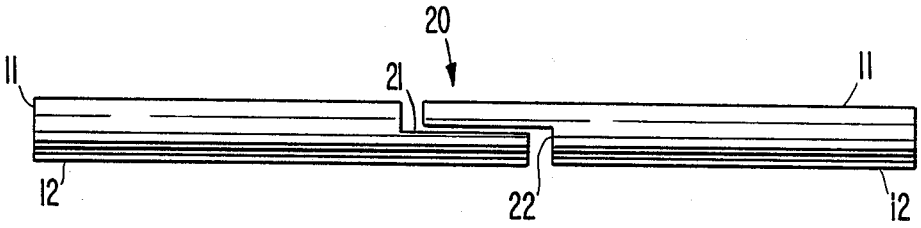
FIG. 3 is a side elevational view of two composite pavement devices.

Referring to FIG. 3, the composite pavement device 10 may be formed with an attachment means 20. The attachment means 20 is formed to longitudinally matingly engage another substantially similar pavement device 10, thereby providing the means to form the appropriate length of the speed bump or warning strip for each application. In one preferred embodiment, the uppermost pavement mixture portion 11 is formed with either an upper indentation 21 or a lower indentation 22. Indentations 22 and 22 are shaped to matingly engage when the pavement devices on which they are formed are placed end to end. Elements 21 and 22 may be bonded with epoxy or any other suitable materials.

Figure 4:
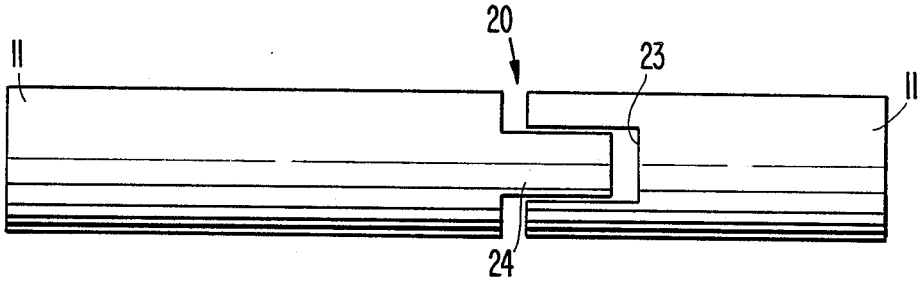
FIG. 4 is a top elevational view of an alternative embodiment of two composite pavement devices.

One alternative embodiment of attachment means 20 is shown in FIG. 4. In that embodiment one pavement device 10 is formed with a groove or channel 23 and a second pavement device is formed with a tongue 24. Groove 23 and tongue 24 are shaped to matingly engage when the pavement devices 10 are placed end to end. Groove 23 and tongue 24 are formed in all layers 11, 12, 13 and 14 of each pavement device 10.

Figure 5:
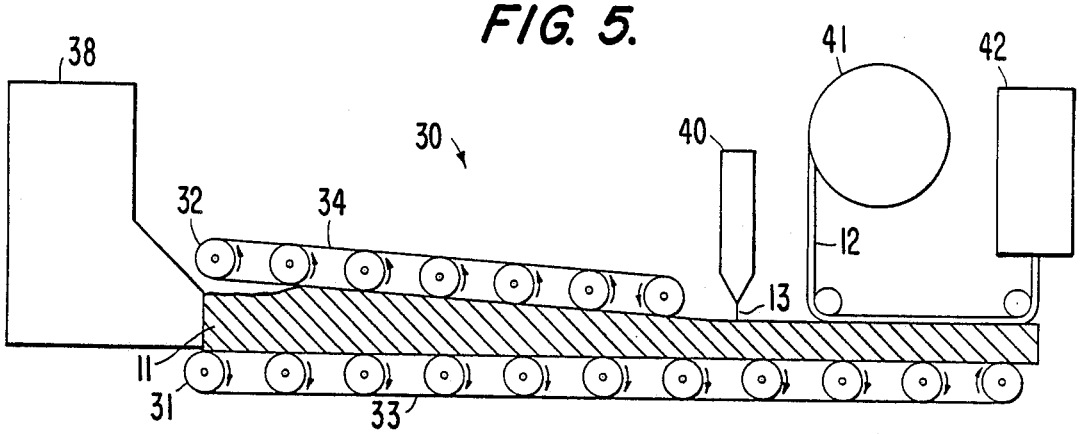
FIG. 5 is a schematic drawing of an apparatus for forming composite pavement devices.
Figure 6:
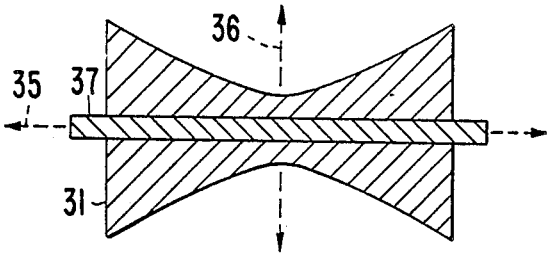
FIG. 6 is a sectional view of a roller from an apparatus for forming composite pavement devices.

FIGS. 5 and 6 show in schematic form a method and machine for making the composite pavement devices of the present invention. According to the preferred method of making these devices, a machine 30 comprises two sets of rollers 31 and 32 surrounded by continuous flexible belts 33 and 34, respectively. The rollers may be formed from stainless steel or any other suitable material. Rollers 32 are substantially cylindrical. Rollers 31 may have sloped or concave cross-sections as shown in FIG. 6. The roller shown in FIG. 6 has a small transverse diameter at its center and slopes radially outward toward both ends. The roller 31 is substantially symmetrical about imaginary axes 35 and 36. Axle 37 passes through roller 31 along imaginary longitudinal axis 35. Axle 37 is threaded at both ends for attachment to conventional roller driving means (not shown). Alternatively, rollers 31 may also be substantially cylindrical.

As shown in FIG. 5, rollers 31 are arranged horizontally and are surrounded by flexible belt 33. Rollers 31 are driven by conventional driving means (not shown), rotating clockwise about axle 37. Rollers 32 are arranged above rollers 31 and belt 33. Rollers 32 are surrounded by flexible belt 34 and are rotated counterclockwise as shown in FIG. 5 about their longitudinal axes by conventional driving means (not shown). The central longitudinal axes of rollers 32 are arranged to slope downwards from the first roller to the last.

In operation, pavement mixture is fed continuously from dispenser 38 onto flexible belt 33. Rotating rollers 31 and 33 propel the pavement mixture 11 forward from left to right as shown in FIG. 5. As the pavement mixture 11 moves forward it is pressed between the downwardly sloped rollers 32 and the horizontal rollers 31. As it is pressed between the two sets of rollers, the pavement mixture takes the shape of the rollers. If concave rollers 31 as shown in FIG. 6 are used, the bottom side of the pavement mixture 11 will have a convex shape while the top side will be substantially flat. If cylindrical rollers 31 are used, both top and bottom sides of pavement mixture 11 will be flat. The thickness, i.e., the distance between the top and bottom sides of the pavement mixture will be determined by the spacing between the sets of rollers 31 and 32. The width of the pavement mixture will be determined by the volume flow rate of pavement mixture 11 from dispenser 38 and the rotational velocity of rollers 31 and 32.

Rollers 32 and flexible belt 34 extend only part way along rollers 31 and belt 33. After being formed to a predetermined size and shape by rollers 31 and 32 as described above, the pavement mixture continues along moving rollers 31 and belt 33. An adhesive 13 such as epoxy is applied to the top side of the shaped pavement mixture by a conventional adhesive dispenser 40. The support portion 12—metal or plastic mesh in the preferred embodiment—is dispensed from storage roll 41 applied to the top side of the pavement mixture and attached thereto by adhesive 13.

The composite pavement mixture and support is fed continuously to cutting means 42. This cutting means may be conventional shears for making straight edges or a combination of shears and dies for making the attachment means 20 described above.

Thus, the composite pavement devices according to this invention are formed from a single layer of plastic mixture bonded to a single layer of plastic or metal mesh. The typical thickness of the pavement layer is $1\frac{1}{8}$ inches to $1\frac{1}{4}$ inches and the mesh may be in the range of 3/16 inches to 5/16 inches, although other widths and thicknesses may also be used. The composite pavement device may be made in any convenient length and thickness and adapted to its specific use as described below.

Figure 7:
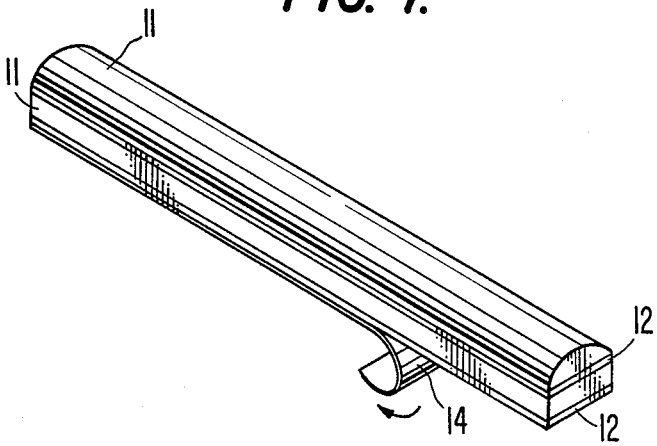
FIG. 7 is an elevational view of two composite pavement devices being used together.

In use, the composite pavement device 10 may be attached to other composite pavement devices to form the size and shape needed for each traffic control application. For example, to form a speed bump, a composite pavement device with a convex cross-section may be attached with epoxy to the top of a similar composite pavement device having a rectangular cross-section as shown in FIG. 7. Multiple layers of composite pavement devices may be bonded together to achieve the desired height. A single composite pavement device of rectangular cross-section may be used as a warning strip or rumble strip.

To achieve the desired length of speed bump or warning strip, composite pavement devices, singly or in multiple layers, may be attached using epoxy in connection with the attachment means 20 described above. The multiple composite pavement devices 10 may be combined either in the field or off-site. The devices 10 may be attached to the road or parking lot with epoxy or any other suitable attachment means. Adhesive 16 may be applied beneath the bottom most layer 12 at the time of manufacture and covered with a sheet of protective paper, plastic or cloth 14 for shipping. The covering 14 would be removed as shown in FIG. 7 prior to application. Because the speed bumps or warning strips made according to this invention may be pre-formed to the desired sizes and shapes off-site, disruption of traffic on the road or through the parking lot is minimized.

I claim:

1. An elongated, prefabricated, composite, self-adhesive roadway warning device for transverse attachment to a roadway surface, said device comprising:

an elongated pavement mixture layer having a first side and an opposite second side, said first side defining an exposed warning surface, an elongated intermediate layer having a first side and an opposite second side, said first side of said intermediate layer being attached to and substantially covering said second side of said pavement mixture layer, an adhesive layer having a first side and an opposite second side, said first side of said adhesive layer being attached to and substantially covering said second side of said intermediate layer, said second side of said adhesive layer adapted to adhere to the roadway surface, and removable covering means attached to said second side of said adhesive layer, wherein said warning surface protrudes from the roadway surface across which said warning device is transversely adhered, said protruding warning surface being adapted to jar vehicles driven over said warning device.

2. The elongated warning device according to claim 1 wherein said second side of said adhesive layer is adapted to be attached to said first side of said pavement mixture layer of a second substantially identical device.

3. The elongated warning device of claim 1 wherein the shape of said first and second sides of said pavement mixture layer is substantially rectangular, the shape of said first and second sides of said intermediate layer is substantially rectangular, and said pavement mixture layer and intermediate layer each having first and second elongated opposite edges and first and second opposite ends substantially perpendicular to said opposite edges.

4. The elongated warning device of claims 1 or 3 wherein said intermediate layer is formed from mesh.

5. The elongated warning device of claim 4 wherein said mesh is formed from plastic.

6. The elongated warning device of claim 4 wherein said mesh is formed from metal.

7. The elongated warning device of claim 3 wherein the distance between said first and second sides of said pavement mixture layer is less than the distance between said opposite elongated first and second edges of said pavement mixture layer.

8. The elongated warning device of claim 3 further comprising means for longitudinally annexing one warning device to another substantially similar warning device to provide a longitudinally extended warning device.

9. The elongated warning device of claim 8 wherein said first end of said pavement mixture layer has a groove portion and said second end of said pavement mixture layer has a tongue portion, said tongue portion being adapted to mate and engage with a groove portion of a second substantially identical warning device and said groove portion being adapted to mate and engage with a tongue portion of a third substantially identical warning device.

* * * * *